US008069679B2

(12) United States Patent
Lebrun et al.

(10) Patent No.: US 8,069,679 B2
(45) Date of Patent: Dec. 6, 2011

(54) INSTALLATION FOR CRYOGENIC COOLING FOR SUPERCONDUCTOR DEVICE

(75) Inventors: Philippe Lebrun, Prevessin (FR); Bruno Vullierme, Annecy (FR)

(73) Assignee: Organisation Europeenne pour la Recherche Nucleaire, Suisse (CH)

( * ) Notice: Subject to any disclaimer, the term of this patent is extended or adjusted under 35 U.S.C. 154(b) by 1165 days.

(21) Appl. No.: 11/814,539

(22) PCT Filed: Jan. 24, 2006

(86) PCT No.: PCT/FR2006/000163

§ 371 (c)(1), (2), (4) Date: Jul. 23, 2007

(87) PCT Pub. No.: WO2006/079711

PCT Pub. Date: Aug. 3, 2006

(65) Prior Publication Data

US 2008/0134691 A1 Jun. 12, 2008

(30) Foreign Application Priority Data

Jan. 27, 2005 (FR) ..... 05 00861

(51) Int. Cl.
*F25B 19/00* (2006.01)

(52) U.S. Cl. ..... 62/51.1

(58) Field of Classification Search ..... None
See application file for complete search history.

(56) References Cited

U.S. PATENT DOCUMENTS 3,537,271 A * 11/1970 Montag ..... 62/49.2
3,880,193 A * 4/1975 Lewis ..... 138/26
4,209,657 A * 6/1980 Inai et al. ..... 174/15.4
4,689,439 A 8/1987 Sato
4,852,357 A * 8/1989 Porter ..... 62/50.4
5,220,800 A * 6/1993 Muller et al. ..... 62/51.1
5,721,522 A * 2/1998 Roth et al. ..... 335/216

FOREIGN PATENT DOCUMENTS

DE 3336466 4/1985
DE 4107320 A1 * 9/1992
FR 2 308 068 11/1976
JP 10132433 5/1998
JP 2001066029 3/2001

OTHER PUBLICATIONS

International Search Report for PCT/FR2006/000163 dated Apr. 27, 2006.

* cited by examiner

*Primary Examiner* — Frantz Jules
*Assistant Examiner* — Lukas Baldridge
(74) *Attorney, Agent, or Firm* — McDonnell Boehnen Hulbert & Berghoff LLP

(57) ABSTRACT

The invention concerns an installation for cryogenic cooling comprising: a main reservoir (1) for a two-phase cryogenic fluid wherein is immersed a superconductor device (4) to be cooled; an auxiliary reservoir (9); and a hydrostatic duct between the bases of the main and auxiliary reservoirs; the auxiliary reservoir being arranged relative to the main reservoir and being dimensioned so as to be able to receive at least a large part of the cryogenic fluid present in liquid form (2) in the main reservoir; restricting means (11) being incorporated in an output manifold (7*a*) connected to the main reservoir; thus, when the superconductor gets rapidly heated, cryogenic liquid from the main reservoir is delivered, by the vaporized cryogenic fluid pressure, into the auxiliary reservoir wherefrom it flows again by gravity towards the main reservoir when the pressure of the vaporized fluid decreases.

5 Claims, 2 Drawing Sheets

INSTALLATION FOR CRYOGENIC COOLING FOR SUPERCONDUCTOR DEVICE

BACKGROUND OF THE INVENTION

1. Field of Invention

The present invention relates in general to the field of installations for cryogenically cooling superconducting devices, and more particularly to improvements made to such installations comprising:

- a tank for a two-phase cryogenic fluid in which a superconducting device to be cooled is immersed;
- a cryogenic fluid supply line functionally associated with the tank in order to supply it with cryogenic fluid;
- a valve for controlling the supply of cryogenic fluid, which is placed in said supply line; and
- an outlet manifold connected to said tank.

2. Description of Background Art

A conventional arrangement of an installation according to the invention is illustrated in FIG. 1 of the appended drawing. A tank 1 contains a two-phase cryogenic fluid, the liquid phase 2 of which lies beneath a vapor phase 3. A superconducting device 4 is immersed in the liquid phase 2. A cryogenic fluid supply line 5 is connected to the tank 1 and a control valve 6, incorporated in the supply line 5, allows the supply of cryogenic fluid into the tank 1 to be controlled. An outlet manifold 7 is provided for discharging the cryogenic fluid vaporized by the thermal loads of the system. Finally, the tank 1 is provided with a level gauge 8, for example functionally associated with the control valve 6, in order to detect the level to which the tank 1 is filled with cryogenic fluid in the liquid phase and for controlling the control valve 6.

The heat loads of the system are absorbed by partial vaporization of the cryogenic liquid, by playing on the latent heat of vaporization of the latter. The vaporized cryogenic fluid is discharged via the outlet manifold 7, whereas cryogenic fluid in the liquid state is supplied according to the requirements under the control of the level gauge 8 and the control valve 6, so that the superconducting device 2 always remains immersed.

However, in the presence of a resistive transition of the device or of any other thermal disturbance resulting in a large and rapid increase in the thermal load, the cryogenic fluid in the liquid state, in contact with which the device must be maintained, rapidly and completely disappears owing to its vaporization, due to the increase in thermal load, and owing to its turbulent entrainment at high flow rate in the outlet manifold. The resumption of cooling of the device and the recovery of its superconductivity state require that cryogenic fluid in the liquid state be again supplied to the tank. This new supply of liquid cryogenic fluid not only requires time, but above all requires an influx of fluid, which proves to be expensive.

SUMMARY OF THE INVENTION

The object of the invention is essentially to propose an improved arrangement for an installation of the type in question, which allows it to operate correctly and reliably under standard thermal conditions but which, under abnormal thermal conditions, allows the device to be reimmersed more rapidly and its superconductivity state recovered more rapidly, and also prevents the loss of liquid cryogenic fluid initially present in the tank, therefore permitting a substantial saving of cryogenic fluid.

For these purposes, the invention provides an installation as mentioned in the preamble which being arranged according to the invention, is characterized in that it further includes:

- an auxiliary tank; and
- a hydrostatic connecting line interposed between the respective bottoms of the main and auxiliary tanks,
- said auxiliary tank being placed relative to the main tank and being dimensioned so as to be able to accommodate at least most of the cryogenic fluid present in liquid form in the main tank,
- said cryogenic fluid supply line being connected to the auxiliary tank,
- an outlet manifold being connected to the auxiliary tank and
- restricting means being incorporated into the outlet manifold connected to the main tank.

Thanks to these arrangements according to the invention, when the superconducting device undergoes rapid heating, a bit of the liquid cryogenic fluid is vaporized but its discharge into the outlet manifold of the main tank is greatly frustrated by the restricting means. Consequently, the pressure of the vaporized cryogenic fluid increases in the tank and at least some of the cryogenic fluid in the liquid state present in the main tank is discharged, under the action of this pressure of the vaporized cryogenic fluid, into the auxiliary tank. This liquid cryogenic fluid present in the auxiliary tank again flows under gravity into the main tank when the pressure of the vaporized fluid decreases in the latter.

Under these conditions, not only is it the discharged cryogenic fluid that is reintroduced into the main tank, but furthermore this filling of the main tank takes place without any delay as soon as the thermal overload has disappeared, and this taking place automatically by simple gravity. The amount of cryogenic fluid that has passed through the restricting means during this process and that has disappeared remains relatively small and in no way comparable with the large volume of fluid both in the vaporized state and the liquid state, which was discharged in a conventional installation under the same circumstances.

In order for the auxiliary tank to be able to be produced in a relatively compact form, it is advantageous for it to be placed substantially higher than the main tank that, furthermore, only a small amount of liquid cryogenic fluid is contained therein under normal thermal conditions.

Preferably therefore, means for detecting the level of the liquid cryogenic fluid are placed in the auxiliary tank.

Depending on the required mode of operation of this installation, the restricting means may simply comprise a restriction, or else, in a more sophisticated construction, they comprise an externally controlled valve.

BRIEF DESCRIPTION OF THE DRAWINGS

The invention will be better understood on reading the following detailed description of a preferred embodiment given solely by way of nonlimiting example. In this example, reference will be made to the appended drawings in which.

DETAILED DESCRIPTION OF THE INVENTION

Figure 1:
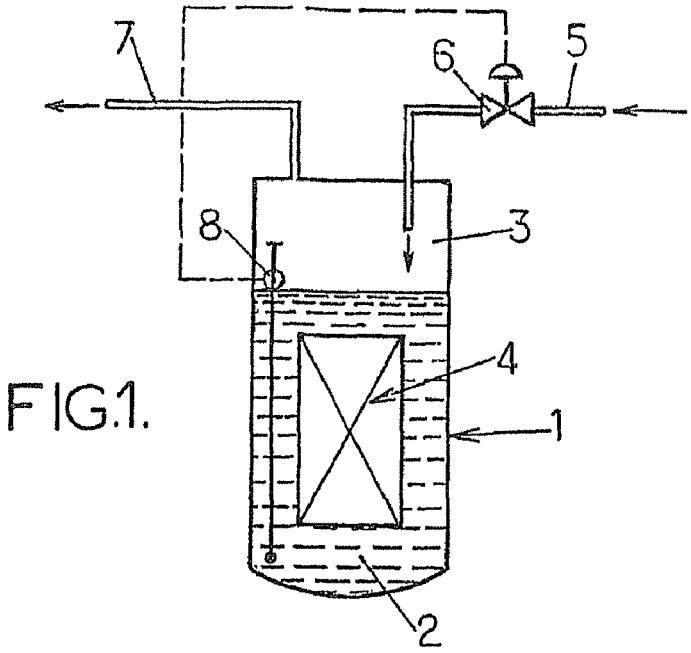
FIG. 1 is a schematic view illustrating a conventional installation as intended by the invention.
Figure 2A:
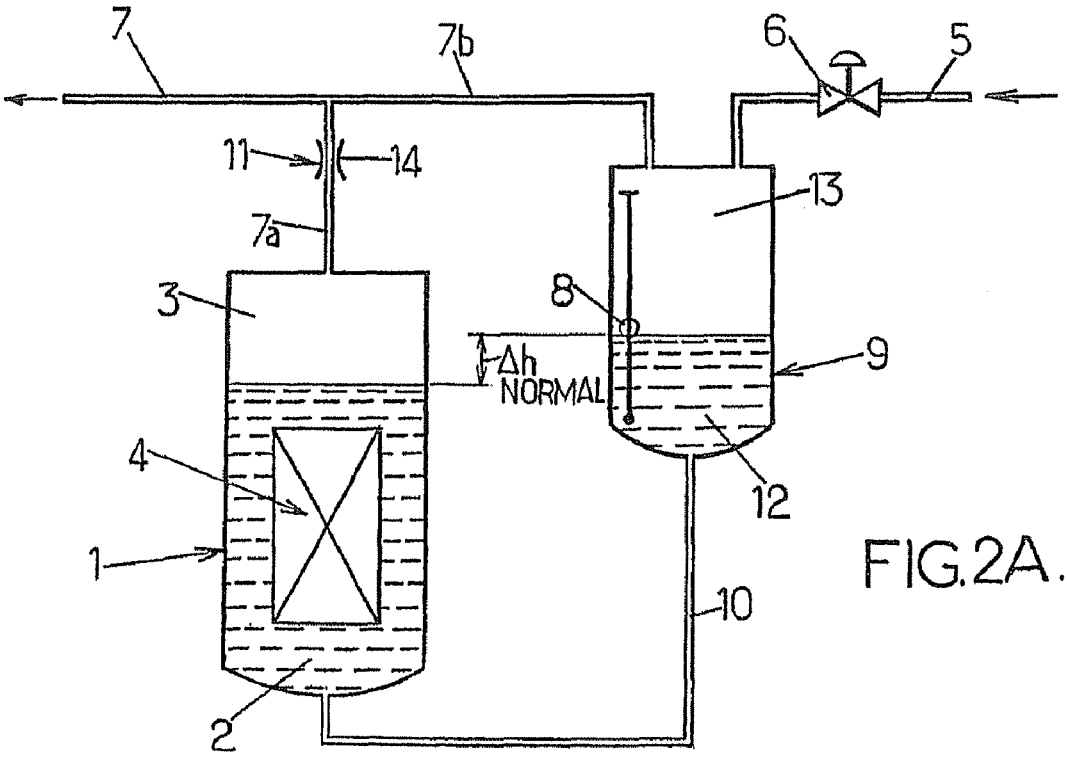
FIG. 2A is a schematic view illustrating an installation of the type of that in FIG. 1 improved according to the invention and shown under normal thermal conditions.

Referring now firstly to FIG. 2A, the installation arranged in accordance with the invention again comprises the elements shown in FIG. 1 but also with a second tank or auxiliary tank 9.

A hydrostatic connecting line 10 is interposed between the respective bottoms of the main 1 and auxiliary 9 tanks. The cryogenic fluid supply line 5, together with its control valve 6, is connected to the auxiliary tank 9 and the level gauge 8 is installed in the auxiliary tank 9.

The auxiliary tank 9 is also equipped with an outlet manifold 7*b*, while the outlet manifold 7*a* of the main tank 1 is provided with restricting means 11. As illustrated in FIG. 2A, the two manifolds 7*a* and 7*b* may be joined together, downstream of the restricting means 11, into a single manifold 7.

The auxiliary tank 9 is placed relative to the main tank 1 and is dimensioned so as to be able to accommodate at least a large part of the cryogenic fluid present in liquid form in the main tank 1. The auxiliary tank 9 is offset vertically upwards relative to the main tank 1.

In normal operation, as shown in FIG. 2A, the cryogenic fluid in liquid form is accommodated in the auxiliary tank 9 and the gaseous transfer losses are discharged directly via the manifold 7*b*. Thus, only cryogen in the purely liquid state is delivered by gravity to the main tank 1 via the overly dimensioned connecting line 10, with a negligible pressure drop. The mass flow rate of vaporized cryogen $m_{normal}$ generated in the cryogenic liquid 2 by a thermal load under normal operation is discharged via the manifold 7*a* through the restricting means 11. The latter are dimensioned so as to allow the normal flow of the gaseous cryogen with a low pressure drop $\Delta p_{normal}$, resulting, owing to the hydrostatic equilibrium existing between the two tanks 1 and 9, a difference in level $\Delta h_{normal}$ between the liquid levels in the two, auxiliary 9 and main 1, tanks respectively.

The volume of the auxiliary tank 9 is such that the liquid 12 present therein lies beneath a relatively large free volume 13 (i.e. containing vaporized cryogen) corresponding at least to most of the liquid cryogen present in the main tank 1.

Figure 2B:
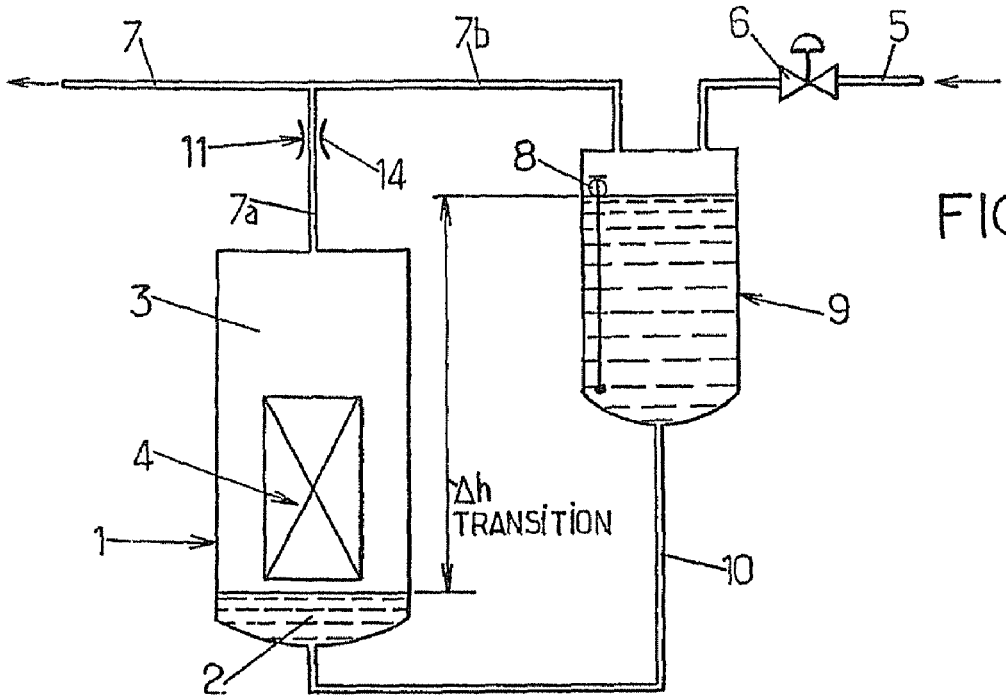
FIG. 2B is a schematic view illustrating the installation of FIG. 2A when there is an appreciable and rapid modification of the thermal conditions.

In the case of a resistive transition in the device 4 or any other thermal perturbation resulting in a substantial and rapid increase in the thermal load, the cryogenic liquid in the tank 1 vaporizes with a mass flow rate very much higher than that in normal operation, i.e. $m_{transition} >> m_{normal}$. As a result, owing to the presence of the restricting means 11 in the outlet manifold 7*a*, which frustrate the flow of the vaporized cryogen, there is a large increase in the pressure drop $\Delta p_{transition}$. Owing to the increase in pressure of the vaporized cryogen in the main tank 1 and because of the hydrostatic equilibrium between the two tanks, this results in a rapid discharge of the remaining liquid cryogen from the main tank 1 into the auxiliary tank 9, as illustrated in FIG. 2B. Thus, the hot device 4, which is no longer immersed, at least in the case of its largest part, in the cryogenic liquid, is thermally decoupled from the latter. Owing to its reflux from the main tank into the auxiliary tank, the cryogenic fluid is saved—it is no longer discharged to the outside and lost as in the case of the conventional installations such as that of FIG. 1. When the gas flow in the manifold 7*a* decreases, the pressure drop in the restricting means 11 also decreases, and therefore the difference in liquid levels in the two tanks decreases until it comes to a point where the transfer of liquid from the auxiliary tank 9 into the main tank 1 can be resumed. The liquid therefore discharges from the auxiliary tank 9 by gravity into the main tank 1 in order to return to the normal situation shown in FIG. 2A, with the device 4 again completely immersed in the cryogenic liquid.

Assuming turbulent gas flow in the outlet manifold 7*a* and the restricting means 11, the following may be written:

$$\Delta h \sim \Delta p \sim m^2$$

and therefore:

$$\Delta h_{transition}/\Delta h_{normal} = \Delta p_{transition}/\Delta p_{normal} = /[m_{transition}/m_{normal}]^2.$$

To give a specific example, if an $m_{transition}/m_{normal}$ ratio as low as 10 is assumed, then $\Delta h_{transition}//\Delta h_{normal}$ is equal to 100, that is to say for example an increase in the difference in liquid levels of 1 cm to 1 m, which easily makes it possible for the superconducting device 4 to no longer be immersed in the liquid, and for the liquid to be retro-displaced.

It should also be emphasized that the nature and the properties of the cryogenic fluid, whether in the liquid phase or in the vapor phase, are not involved, which means that the arrangements according to the invention may be implemented without any limitation. It is merely sufficient for the outlet manifold 7*a* and the restricting means 11 to be appropriately dimensioned according to the properties of the cryogenic fluid in its liquid and gaseous phases, and also according to the expected thermal loads in normal operation.

Figure 3:
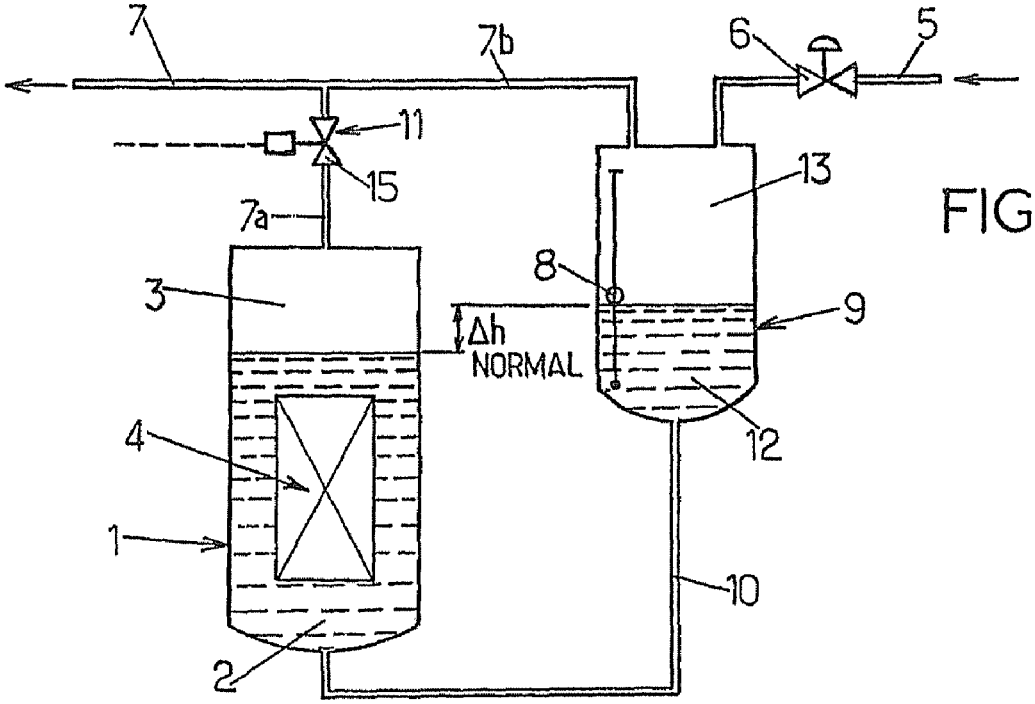
FIG. 3 is a schematic view similar to that of FIG. 2A showing an advantageous alternative embodiment of the installation according to the invention.

In the simple embodiment illustrated in FIGS. 2A and 2B, the restricting means 11 comprise a fixed restriction 14 inserted in the line 7*a*. However, other arrangements are conceivable depending on the required mode of operation of the installation. Thus, the restricting means 11 may comprise, instead of the aforementioned simple fixed restriction 14, an externally operated valve 15 as illustrated in FIG. 3. Such an arrangement makes it possible in particular to increase the effectiveness of the liquid cryogen reflux and to control the restart of liquid cryogen transfer into the main tank 1 and to resume cooling of the superconducting device 4.

The invention claimed is:

1. A cryogenic cooling installation for a superconducting device, comprising:

a main tank for a two-phase cryogenic fluid in which a superconducting device to be cooled is immersed;

a first outlet manifold connected to said main tank;

an auxiliary tank;

a second outlet manifold connected to said auxiliary tank;

a cryogenic fluid supply line functionally associated with said main tank in order to supply said main tank with cryogenic fluid, and connected to said auxiliary tank;

means for controlling a supply of cryogenic fluid, which is placed in said supply line; and a hydrostatic connecting line interposed between respective bottoms of said main and auxiliary tanks, wherein said installation further includes restricting means incorporated into said first outlet manifold, said auxiliary tank being placed relative to said main tank and being dimensioned, so as to be able to accommodate at least most of the cryogenic fluid present in liquid form in said main tank when discharged through the hydrostatic connecting line under the action of pressure of vaporized cryogenic fluid in said main tank, and able to reintroduce the discharged liquid cryogenic fluid through the hydrostatic connecting line from said auxiliary tank into said main tank automatically by gravity without any delay, when the pressure in said main tank decreases.

2. The installation as claimed in claim 1, wherein said auxiliary tank is placed substantially higher than said main tank.

3. The installation as claimed in claim 1, wherein means for detecting the level of the liquid cryogenic fluid is placed in said auxiliary tank.

4. The installation as claimed in claim 1, wherein said restricting means comprises a restriction.

5. The installation as claimed in claim 1, wherein said restricting means comprises an externally controlled valve.

* * * * *